US006581856B1

(12) United States Patent
Srinath

(10) Patent No.: US 6,581,856 B1
(45) **Date of Patent: *Jun. 24, 2003**

(54) FLUID MIXER

(75) Inventor: Dharapuram N. Srinath, Ellicott City, MD (US)

(73) Assignee: Bowles Fluidics Corporation, Columbia, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/433,344

(22) Filed: Nov. 4, 1999

Related U.S. Application Data

(60) Provisional application No. 60/107,328, filed on Nov. 6, 1998.

(51) Int. Cl.[7] ..... B05B 1/08

(52) U.S. Cl. ..... 239/589.1; 239/428; 239/428.5

(58) Field of Search ..... 239/589.1, 428.5, 239/428, 429, 433; 137/842, 826, 806

(56) References Cited

U.S. PATENT DOCUMENTS 3,468,325 A * 9/1969 Bowles
3,563,462 A * 2/1971 Bauer
3,654,944 A * 4/1972 Laakaniemi et al.
3,669,135 A * 6/1972 Starr
3,989,187 A * 11/1976 Osheroff
4,122,845 A * 10/1978 Stouffer et al.
4,231,519 A * 11/1980 Bauer
4,458,842 A * 7/1984 Keller
4,774,975 A * 10/1988 Ayers et al.

* cited by examiner

*Primary Examiner*—Michael Mar
*Assistant Examiner*—Christopher Kim
(74) *Attorney, Agent, or Firm*—Jim Zegeer

(57) ABSTRACT

A fluid mixer and distribution device which comprises an oscillation/mixing chamber having an upstream end, a downstream end, top and bottom walls, sidewalls which diverge from the upstream end and then converge towards the downstream end. A power nozzle, adapted to be coupled to a source of liquid under pressure, issues a main jet of carrier fluid (a liquid, for example) into the upstream end of the oscillation/mixing chamber. The oscillation/mixing chamber has a pair of control ports symmetrically contiguous to the side of the main jet of liquid, and an exit aperture at the downstream end of the oscillation/mixing chamber for the egress of the mixed fluids from the oscillation/mixing chamber to ambient or a point of utilization. One or more sources of fluent materials connected to the control ports, whereby any vacuum caused by the main jet of liquid at the control ports entrains the fluent material for mixing with the carrier jet of liquid in the oscillation/mixing chamber to form a mixture for spraying to ambient through the exit aperture or to a utilization device.

4 Claims, 3 Drawing Sheets

FLUID MIXER

REFERENCE TO RELATED APPLICATION

The present application is the subject of provisional application Serial. No. 60/107,328 filed Nov. 6, 1998 and entitled A FLUID DISTRIBUTOR WITH MIXING CHAMBER.

BACKGROUND AND BRIEF DESCRIPTION OF THE INVENTION

The present invention is directed to a fluid mixing device and more particularly to fluid mixing devices incorporating fluidic and vortical flow effects to enhance mixing of a fluent material with a carrier fluid.

According to the invention a fluid mixer and distribution device has a mixing chamber having an upstream end, a downstream end, top and bottom walls, sidewalls which diverge from the upstream end and converge towards the downstream end, a power nozzle adapted to be coupled to a source of carrier fluid under pressure for issuing a main jet of fluid, a liquid, for example, into the upstream end of the mixing chamber. The mixing chamber has a pair of control ports symmetrically contiguous to the side of the main jet of liquid, and an exit aperture at the downstream end of the mixing chamber for the egress of fluids from said mixing chamber to ambient, and one or more sources of fluent materials connected to the control ports, whereby any vacuum caused by the main jet of liquid at the control ports entrains the fluent material for mixing with the main jet of liquid in a mixing chamber to form a mixture for spraying to ambient through the exit aperture.

Thus, the object of the invention is to provide an improved mixing device utilizing fluid flow phenomena.

DESCRIPTION OF THE DRAWINGS

The above and other objects, advantages and features of the invention will become more clear when considered with the following specification and accompanying drawings wherein.

DETAILED DESCRIPTION OF THE INVENTION

Figure 1:
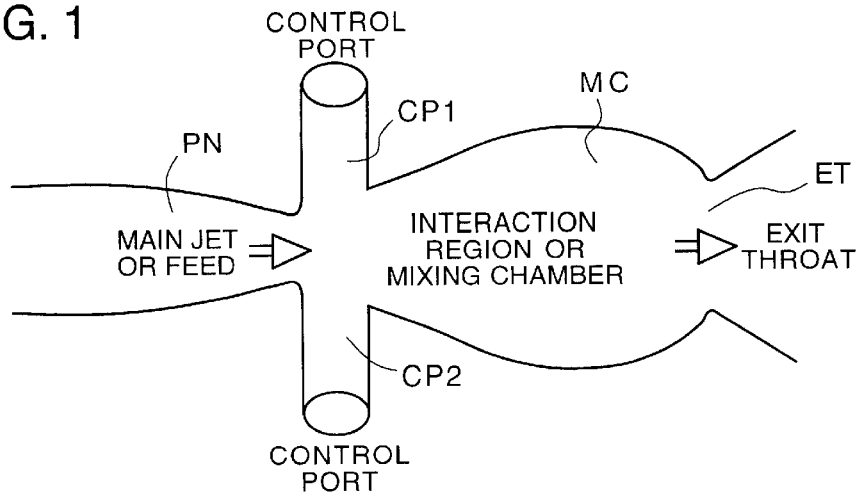
FIG. 1 is illustrative of the basic mixer configuration.
Figure 2B:
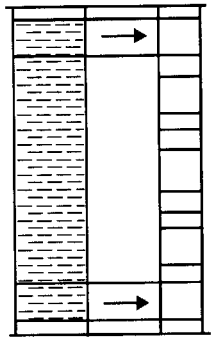
FIG. 2B is a sectional view thereof.
Figure 2A:
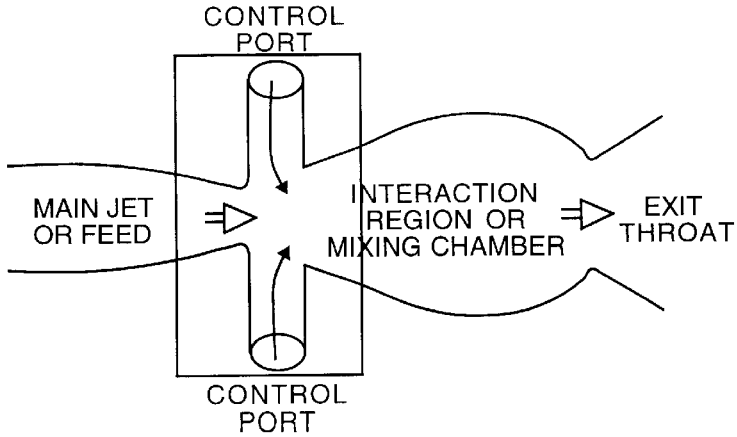
FIG. 2A is illustrative of the basic mixer configuration with the control ports connected to a source of fluent material for mixing with a carrier fluid.
Figure 2D:
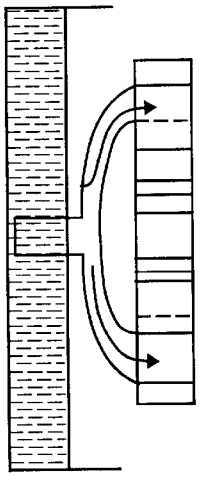
FIG. 2D is a sectional view thereof.
Figure 2C:
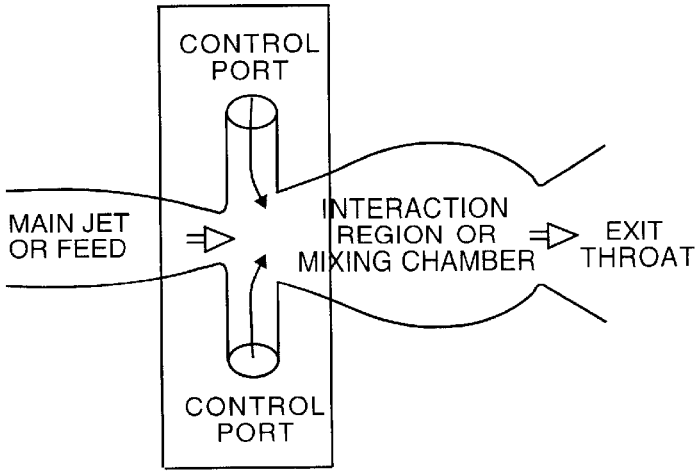
FIG. 2C is illustrative of the basic mixer showing a remote fluent material source.

The device comprises a power nozzle PN that feeds a main jet of carrier fluid, which may be liquid or gas, to an interaction region or mixing chamber MC. The interaction region has two control ports CP1, CP2 which are symmetrically located on either side of the power nozzle PN on its downstream side. The opposite end of the interaction region has an exit throat ET from which the operating fluid egresses. The various regions discussed above are shown in FIG. 1.

Method of Operation

Figure 3B:
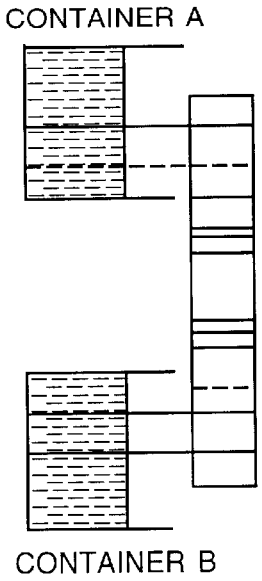
FIG. 3B is a sectional view thereof.
Figure 3A:
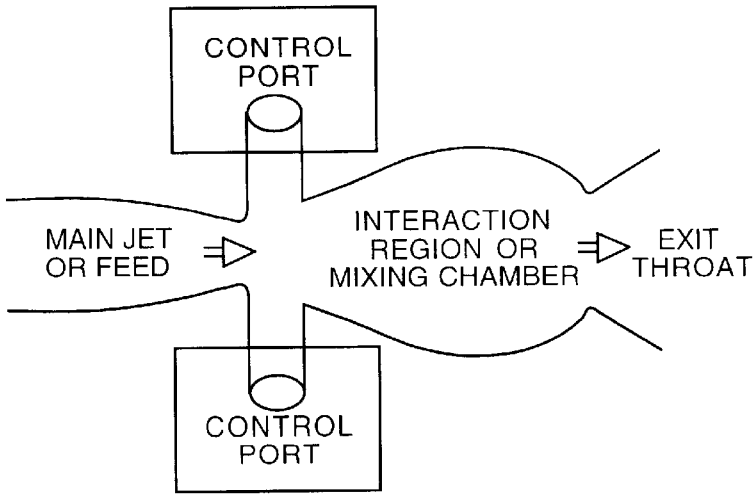
FIG. 3A illustrates the mixing of a carrier liquid with two different fluent materials.

The feed, or the power nozzle end PN of the mixer is hooked up to the source of the operating carrier liquid under pressure. The jet that issues from the power nozzle PN creates a vacuum in the control port area and entrains the ambient air, continues on into the interaction region, and egresses from the exit throat. The flow of the liquid would continue in this format if the control ports were exposed to air. However, if the control ports are connected to a source of a fluent material to be mixed with the carrier liquid as shown in FIGS. 2A, 2B and 2C and 2D or the two different sources S1, S2 of liquid as shown in FIGS. 3A, 3B the vacuum created by the main jet will entrain the liquid in the container(s) S1, S2.

When the entrained liquid flows into the interaction region through the control ports, it allows the formation of liquid vortices (FIGS. 4A, 4B, and 4C) on either side of the main jet, and the device fills up with liquid displacing the air. The formation of the vortices on either side of the jet creates oscillation of the jet exiting from the throat. The oscillations stop if the liquid entrainment through the control port ceases.

Figure 4A:
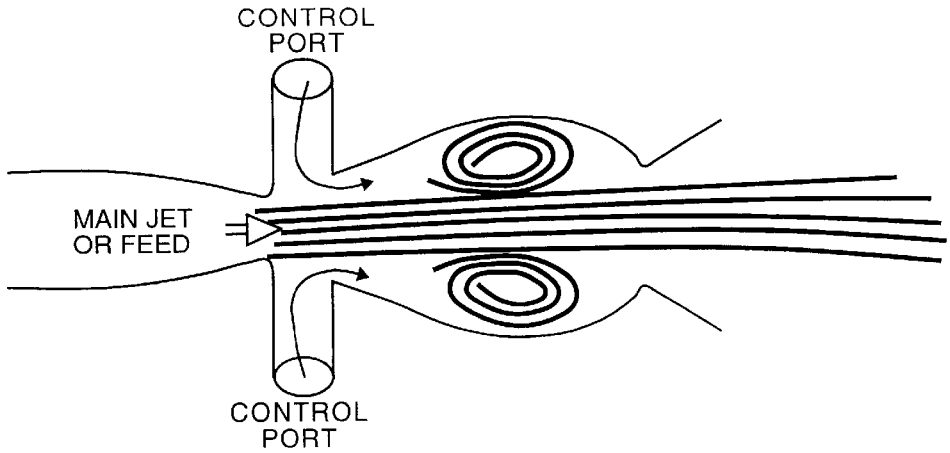
FIGS. 4A, 4B and 4C illustrate the formation of vortices in the mixing chamber.
Figure 4B:
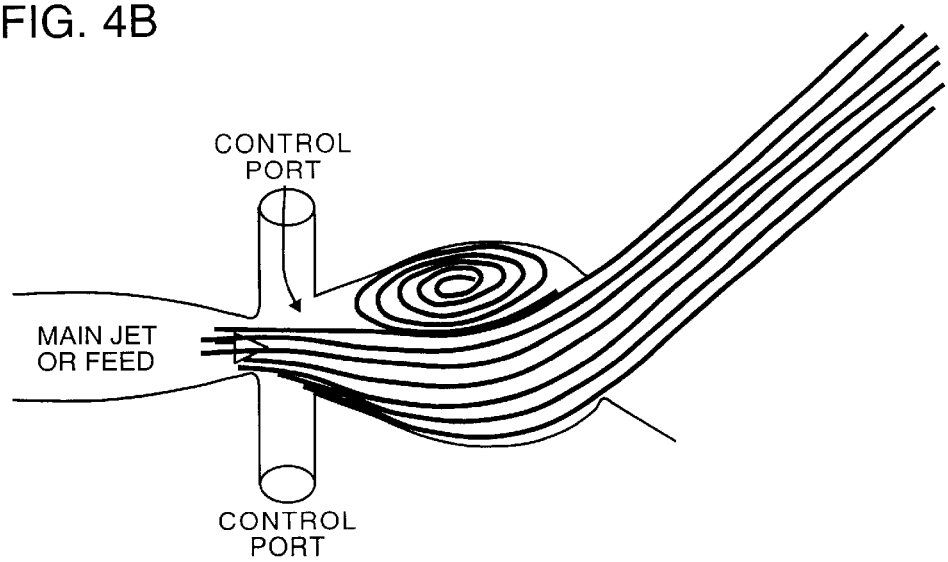
Figure 4C:
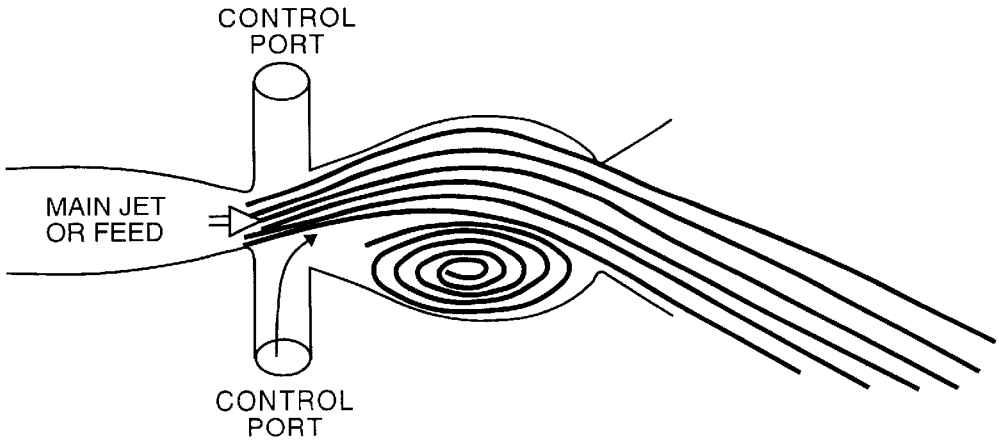

The formation of the vortices and the flow pattern in extreme jet positions during oscillation are shown in FIGS. 4A, 4B and 4C.

The mixing is accomplished by the interaction of the entrainment with the main jet at the control port as well as, to a large degree, with the vortex flow in the interaction region.

Advantages

- Provides uniform mixing due to the agitation action of the vortices. In conventional venturi nozzles mixing may be non-uniform due to the fact that the primary mixing means is dispersion of the mix once it is combined with the main jet.
- Provides automatic proportioning of the fluid to be mixed at different flow rates over a wide range of operating pressures. Mixed volume has been verified to be within 0.3% of the main flow over the operating pressure range of 3.5. Over an operating pressure range of 4 to 14 psi, with two different sizes of entrainment tubing, the fluid entrained remained constant as a percentage of the flow rate through the device.
- Provides an automatic indication when fluid to be mixed runs out. This is because the oscillation (and therefore distribution) does not occur if there is no entrainment. In venturi type nozzles, separate indication is needed if mixing fluid is empty.
- The volume of the entrainment may be controlled by adjusting the size of the control ports.
- Two or more different liquids may be mixed by connecting the two control ports to different liquid sources as shown in FIG. 3.

Typical Applications

- Household mixing applications such as garden sprayers where lawn fertilizer or weed killer is mixed with water before spraying.
- Cleaning applications for household and industrial use where chemicals are mixed before spraying on the target.
- Mixing applications in industries where production or testing processes need mixing of substances.

While the invention has been described in relation to preferred embodiments of the invention, it will be appreciated that other embodiments, adaptations and modifications of the invention will be apparent to those skilled in the art.

What is claimed is:

1. A fluid mixer and vortex distribution device comprising:

an oscillation and mixing chamber having an upstream end, a downstream end, top and bottom walls, curved sidewalls which diverge from said upstream end and converge towards said downstream end, a power nozzle adapted to be coupled to a source of liquid under pressure for issuing a main jet of liquid into the upstream end of said oscillation and mixing chamber, said oscillation and mixing chamber having a pair of control ports symmetrically contiguous to the side of said main jet of liquid, and an exit aperture at the downstream end of said oscillation and mixing chamber for the egress of fluids from said oscillation and mixing chamber to ambient, and one or more sources of fluent materials connected to said control ports, whereby any vacuum caused by said main jet of liquid at said control ports entrains said fluent material and forming vortices on either side of said jet of liquid and create oscillation of the liquid jet exiting out and mixing entrained fluent material with said main jet of liquid in said oscillation and mixing chamber to form a mixture prior to passing through said exit aperture to a point of utilization, and said oscillation of the liquid jet stops when entrainment of said fluent material through said control port ceases.

2. The invention defined in claim 1 wherein each control port is connected to a different source of fluent material, respectively.

3. A fluidic mixer comprising:

a housing having an oscillation vortex mixing chamber with an upstream end and a downstream end, said oscillation vortex mixing chamber having a pair of curved sidewalls which first diverge in a downstream direction from said upstream end to a point of maximum divergence and then converge towards said downstream end, a power nozzle at said upstream end of said oscillation vortex mixing chamber, said power nozzle being adapted to be coupled to a source of carrier liquid under pressure for issuing a jet of carrier liquid into said oscillation vortex mixing chamber, at least one outlet from said mixing chamber, and a pair of control ports at said upstream end of said oscillation vortex mixing chamber such that said jet of carrier liquid entrains fluent material alternately from said control ports, and passages for coupling said pair of control ports to one or more fluent material source for mixing by vortex action in said oscillation vortex mixing chamber with said jet of carrier liquid prior to exiting from said oscillation vortex mixing chamber through said at least one outlet, whereby when said jet of carrier liquid entrains fluent material from said control ports, said jet of carrier liquid oscillates and oscillation of said jet of carrier liquid stops when entrainment of fluent material through said control ports ceases.

4. The invention defined in claim 3 wherein each control port is connected to a different source of fluent material, respectively.

* * * * *